US008287439B2

(12) United States Patent
Evans et al.

(10) Patent No.: US 8,287,439 B2
(45) Date of Patent: Oct. 16, 2012

(54) SELF-OPERATING BACK STRETCHING DEVICE

(76) Inventors: Joseph W. Evans, Houston, TX (US); Robert G. Gottlieb, Houston, TX (US)

( * ) Notice: Subject to any disclaimer, the term of this patent is extended or adjusted under 35 U.S.C. 154(b) by 261 days.

(21) Appl. No.: 12/838,730

(22) Filed: Jul. 19, 2010

(65) Prior Publication Data

US 2012/0015786 A1 Jan. 19, 2012

(51) Int. Cl.

| | |
|---|---|
| ***A63B 21/00*** | (2006.01) |
| ***A63B 21/068*** | (2006.01) |
| ***A63B 26/00*** | (2006.01) |
| ***A63B 71/00*** | (2006.01) |

(52) U.S. Cl. ..... 482/145; 482/96; 482/132; 482/139; 482/142; 482/907

(58) Field of Classification Search ..... 482/51–53, 482/57, 62, 66–68, 70–71, 92–93, 95–96, 482/131–140, 142–145, 148, 907; 601/5, 601/23–26; D21/662, 673, 676, 686–691; *A63B 21/00, 21/068, 26/00, 71/00*

See application file for complete search history.

(56) References Cited

U.S. PATENT DOCUMENTS

| | | | | |
|---|---|---|---|---|
| 1,804,441 | A | 5/1931 | Silva | |
| 4,489,713 | A | 12/1984 | Latenser | |
| 4,489,936 | A * | 12/1984 | Dal Monte | 482/96 |
| 4,502,170 | A | 3/1985 | Morrow | |
| 4,531,514 | A | 7/1985 | McDonald et al. | |
| 4,583,731 | A | 4/1986 | Crivello et al. | |
| 4,750,741 | A | 6/1988 | Smolanovich | |
| 4,819,936 | A | 4/1989 | Muller | |
| 4,826,158 | A | 5/1989 | Fields, Jr. | |
| 5,097,553 | A | 3/1992 | Boland | |
| 5,100,131 | A | 3/1992 | Fong | |
| 5,256,126 | A | 10/1993 | Grotstein | |
| 5,421,801 | A | 6/1995 | Davies, III et al. | |
| 5,573,485 | A | 11/1996 | Geschwender | |
| 5,653,665 | A | 8/1997 | Neeley | |
| 5,702,334 | A * | 12/1997 | Lee | 482/140 |
| 5,772,612 | A | 6/1998 | Ilan | |
| 5,833,590 | A | 11/1998 | Chiu et al. | |
| 5,938,573 | A | 8/1999 | Davies, III et al. | |
| 5,989,168 | A * | 11/1999 | See | 482/142 |
| 6,113,564 | A | 9/2000 | McGuire | |
| 6,117,095 | A | 9/2000 | Daggett et al. | |
| 6,206,809 | B1 * | 3/2001 | Habing et al. | 482/96 |

(Continued)

*Primary Examiner* — Oren Ginsberg
(74) *Attorney, Agent, or Firm* — Lyman H. Smith

(57) ABSTRACT

A manually operated back stretching device may relieve compressive forces of the lower lumbar vertebrae and may safely stretch lower back muscles. The device may include a platform to support a user's lower legs. As the user moves a portion of the device with their arms towards their legs, the forward edge of the platform may rise up and tilt away from the user's torso, causing the user's hips to lift off the floor and stretching the user's back at the same time. As the user moves their arms back over their head, the user's back and legs may relax while the arms are pulled above the user's head. The result may be a back-and-forth dynamic rotational arching motion to repetitively raise the completely relaxed hips and tilt them forward to decompress the spine using appropriate longitudinal and torsion forces at the most pain causing compression points of the lower lumbar vertebrae. The device may safely stretch lower back muscles by incrementally stretching and releasing totally relaxed muscles a relative amount to squeeze out and remove toxic biochemicals from damaged muscle areas unreachable by direct massage.

7 Claims, 9 Drawing Sheets

U.S. PATENT DOCUMENTS 6,443,916 B1 9/2002 Ilan
6,569,069 B1 5/2003 Linares
6,692,451 B2 2/2004 Splane, Jr.
6,695,753 B2 * 2/2004 Ho et al. ..... 482/95
6,726,609 B2 4/2004 Kuo
6,835,170 B2 12/2004 Ogle
6,994,683 B1 2/2006 Starr
7,121,985 B2 * 10/2006 Cheng ..... 482/57
7,169,097 B1 * 1/2007 Stearns ..... 482/142
7,458,922 B2 12/2008 Pisciottano
7,651,446 B1 * 1/2010 Eschenbach ..... 482/52
2005/0181917 A1 8/2005 Dayal
2008/0122278 A1 5/2008 Lightbourne
2008/0182730 A1 7/2008 Conley et al.
2009/0240282 A1 9/2009 Mayer

* cited by examiner

SELF-OPERATING BACK STRETCHING DEVICE

BACKGROUND OF THE INVENTION

The present invention relates to body stretching devices and, more particularly, to a self-operating device for stretching a user's back.

Current methods for stretching a person's back use traction devices, such as those used at a chiropractor's office, to relieve compressive forces. These devices require the user to lie on a relatively flat surface in which a hip harness applies non-dynamic longitudinal forces without the use of torsion forces. This can be quite painful and difficult to tolerate. Since the spine is curved, pulling on a curved weight bearing structure requires extra longitudinal tension force to accomplish the same result as a combined longitudinal and torsion force application using simple leverage and the body's own weight.

U.S. Pat. No. 6,443,916 uses elliptical vertical motion to raise the hip and tilt it forward. The motion's amplitude and frequency cannot be controlled by the user. In addition, the device of the '916 patent requires electricity for operation.

As can be seen, there is a need for a device, for which the user may have control that may stretch a user's back.

SUMMARY OF THE INVENTION

In one aspect of the present invention, a device comprises a platform attached to a first end of first and second extension arms; first and second fulcrum legs extending from the first end of the first and second extension arms, respectively; a first end of first and second adjustable legs pivotably attached to a second end of the first and second extension arms; and wheels attached to a second end of the first and second adjustable legs.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention provides a manually operated back stretching device that may relieve compressive forces of the lower lumbar vertebrae and may safely stretch lower back muscles. The device may include a platform to support a user's lower legs. As the user moves a portion of the device with their arms towards their legs, the platform may rise up and away from the user's torso, causing the user's hips to lift off the floor and stretching the user's back at the same time. As the user moves their arms back over their head, the user's back and legs may relax while the arms are pulled above the user's head. The result may be a back-and-forth dynamic rotational arching motion to repetitively raise the completely relaxed hips and tilt them forward to decompress the spine using appropriate longitudinal and torsion forces at the most pain causing compression points of the lower lumbar vertebrae. The device may safely stretch lower back muscles by incrementally stretching and releasing totally relaxed muscles a relative amount to squeeze out and remove toxic biochemicals from damaged muscle areas unreachable by direct massage.

The device of the present invention may use gravity forces in combination with light forces by the arms to execute a series of slow, levered-action forward pelvic tilt movements in a completely relaxed state while laying supine on a flat underlying surface with the legs and back in a sitting position and the hips slightly suspended above the underlying surface. The user may adjust their required levered-action forward and backward motion to tilt the pelvis forward and backward to prohibit any potential pain encountered through their own pain feedback mechanism.

Figure 1:
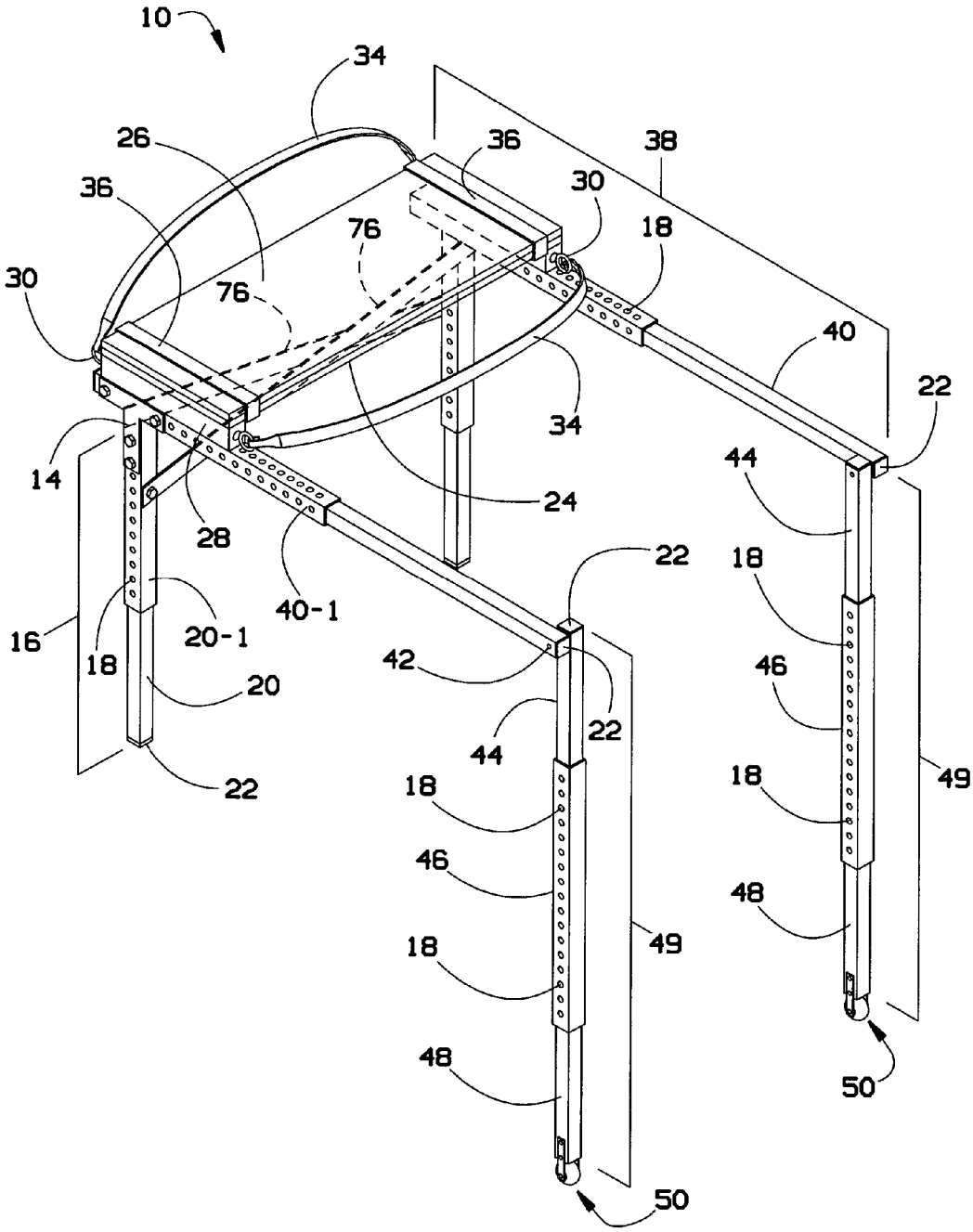
FIG. 1 is a perspective view of a stretching device according to an embodiment of the present invention.
Figure 2:
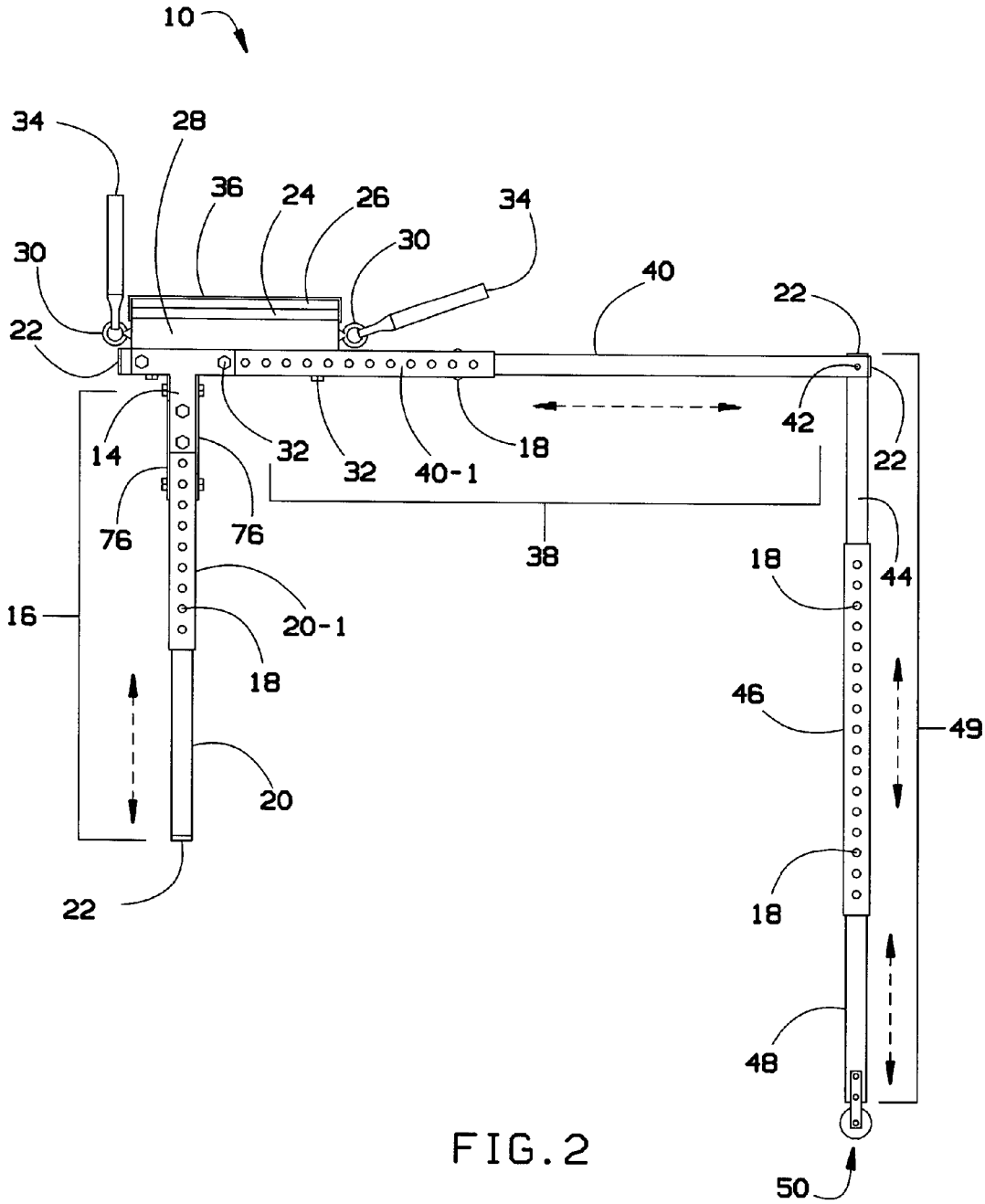
FIG. 2 is a side view of the stretching device of FIG. 1.

Referring to FIGS. 1 and 2, a stretching device 10 may include a platform 24 attached near a first end of first and second extension arms 38. The platform may be covered with a cushion 26 held in place with an adjustable cushion strap. The platform 24 may be raised from the extension arms 38 by the use of elevating blocks 28. First and second vertical fulcrum legs 16 may be attached, extending below the platform 24, to first and second extension arms 38 forming approximately 90 degree angles therebetween. A T-bracket 14 with bolts 32 may be used for joining the fulcrum legs 16 to the extension arms 38. The fulcrum legs 16 may be height adjustable by known means, such as by the use of a lower leg tube 20 insertable into and extending from an upper leg tube 20-1. A locking device, such as a pin (not shown) inserted into holes 18 in the upper leg tube 20-1, may be used to adjust the height of the fulcrum legs 16. Protective tips 22 may be installed at ends of the fulcrum legs 16. One or more straps 34 may be disposed to hold a user's legs onto the platform 24, as described below. The straps 34 may be attached to the platform 24, the elevating blocks 28 and/or the extension arms 38 by known means, such as a hook and eye, a snap, hook and loop fastener (i.e., Velcro®), or the like. In one embodiment, the straps 34 may be removable and adjustable.

At a second end of the first and second extension arms 38 may be hingedly attached at a pivot point 42 to the first and second adjustable legs 49. The length of the extension arms 38 may be adjustable by known means, such as by the use of an inner arm 40 fitting inside an outer arm 40-1. Adjustments may be made by conventional means, such as a twist-lock, pins and holes, or the like. The adjustable legs 49 may be adjustable in a similar or different manner from the extension arms 38. In one embodiment, as shown in FIG. 1, upper and lower leg tubes 44, 48 may fit inside a middle leg tube 46. The middle leg tube 46 may include a plurality of holes 18. Pins (not shown) may secure the upper and lower leg tubes 44, 48 into the middle leg tube 46. Wheels 50 may be disposed at ends of the lower leg tubes 48. Support brackets 76 may optionally be disposed between adjacent fulcrum legs 16 for added support.

Figure 3:
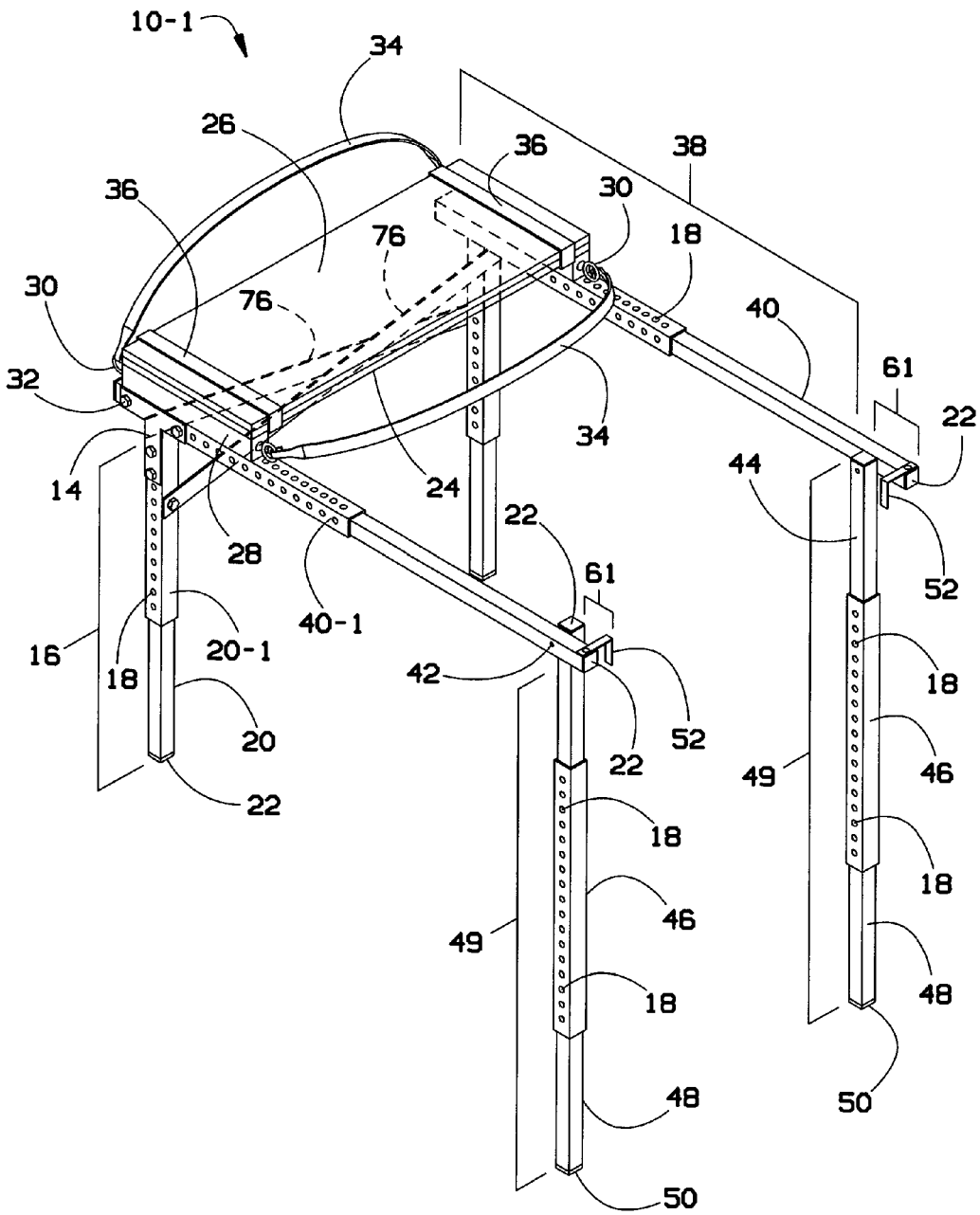
FIG. 3 is a perspective view of a stretching device according to an alternate embodiment of the present invention.
Figure 4:
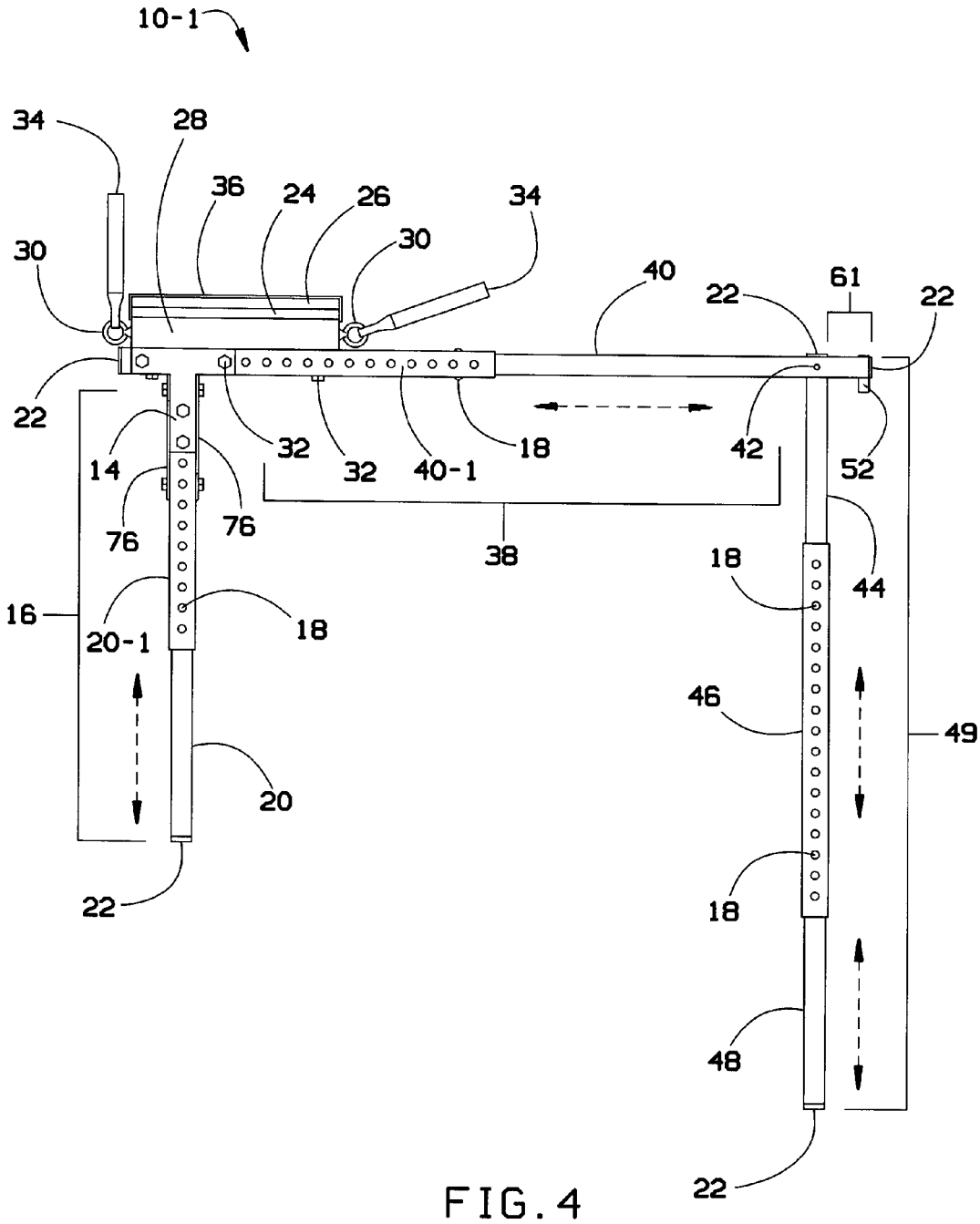
FIG. 4 is a side view of the stretching device of FIG. 3.

As shown in FIGS. 3 and 4, an alternate embodiment of a stretching device 10-1 may include adjustable legs 49 that may be hingedly attached to the extension arms 38 at a distance 61 from the ends of the extension arms 38. The distance 60 may be varied to adjust the lift and rotation of the platform 24 during use of the device. The legs 49 may pivot only a fixed amount at the pivot point 42. The pivot may be limited by, for example, a bracket 52 attached to the extension arms 38. In this embodiment, the wheels 50 (see FIG. 1) may not be needed, as the user may simply lift the legs 49 off the floor.

Figure 5:
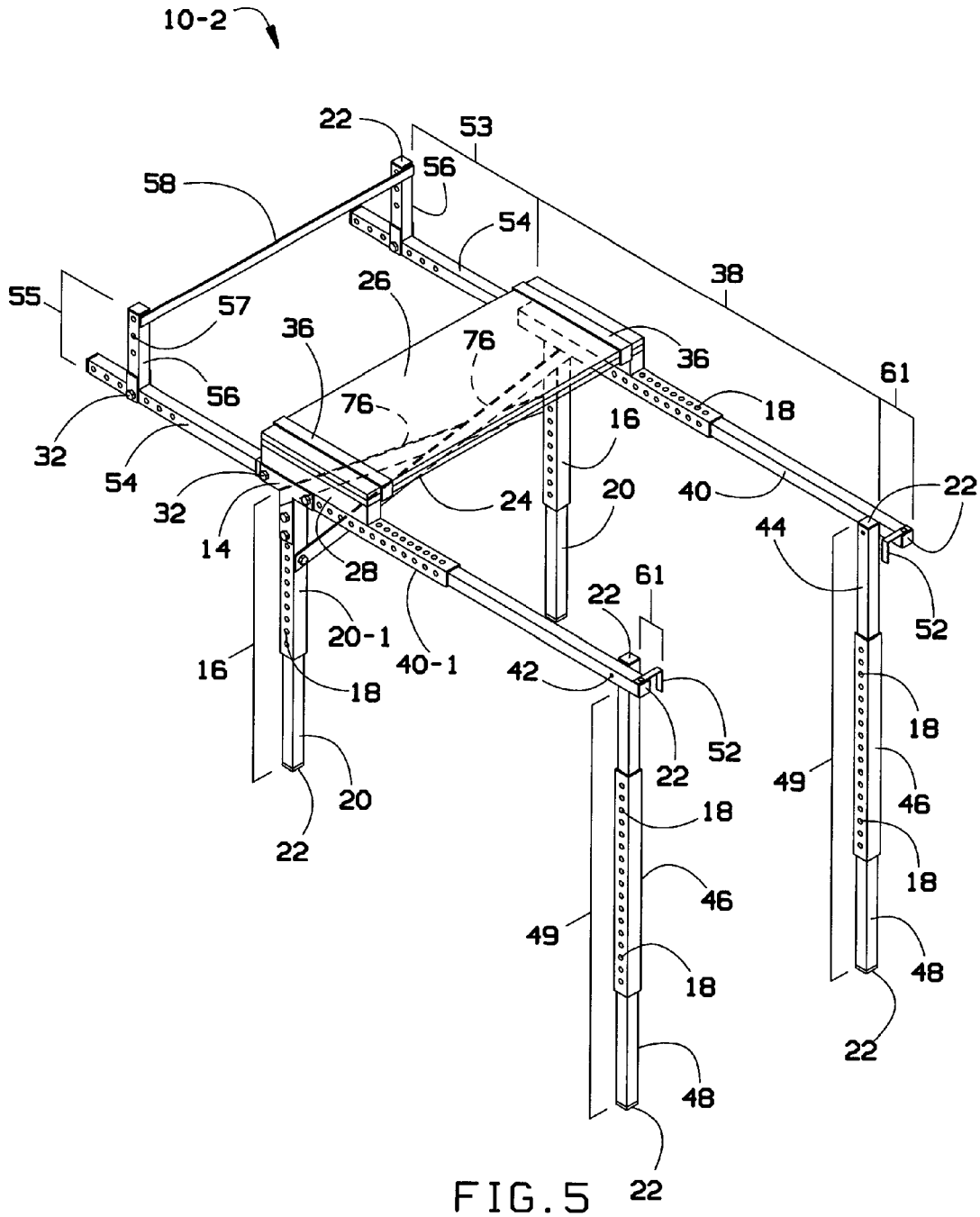
FIG. 5 is a perspective view of a stretching device according to another alternate embodiment of the present invention.
Figure 6:
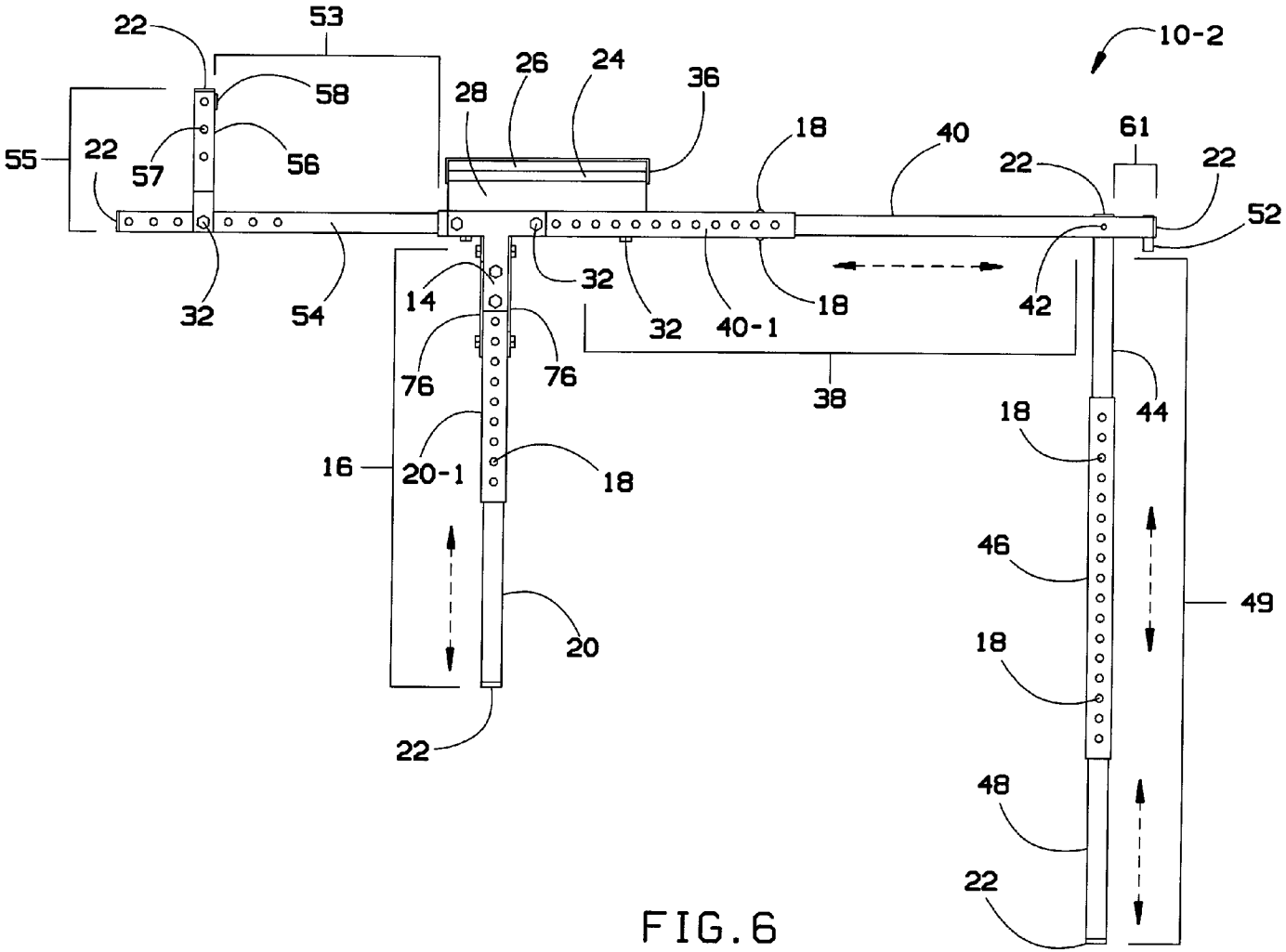
FIG. 6 is a side view of the stretching device of FIG. 5.

Referring to FIGS. 5 and 6, in another embodiment of a stretching device 10-2, an ankle strap 58 may be disposed on a riser tube 56 adjustably attached to an extension tube 54, the extension tube 54 being attached to the extension arms 38. A distance 53 of the ankle strap 58 from the platform 24 may be adjusted based on the comfort of the user to help secure the user's legs to the platform 24. The distance 53 may be adjustable by known means, such as by pins and holes. A height 55 of ankle strap 58 may also be adjustable by, for example, various height holes 57 in the riser tube 56.

Figure 7:
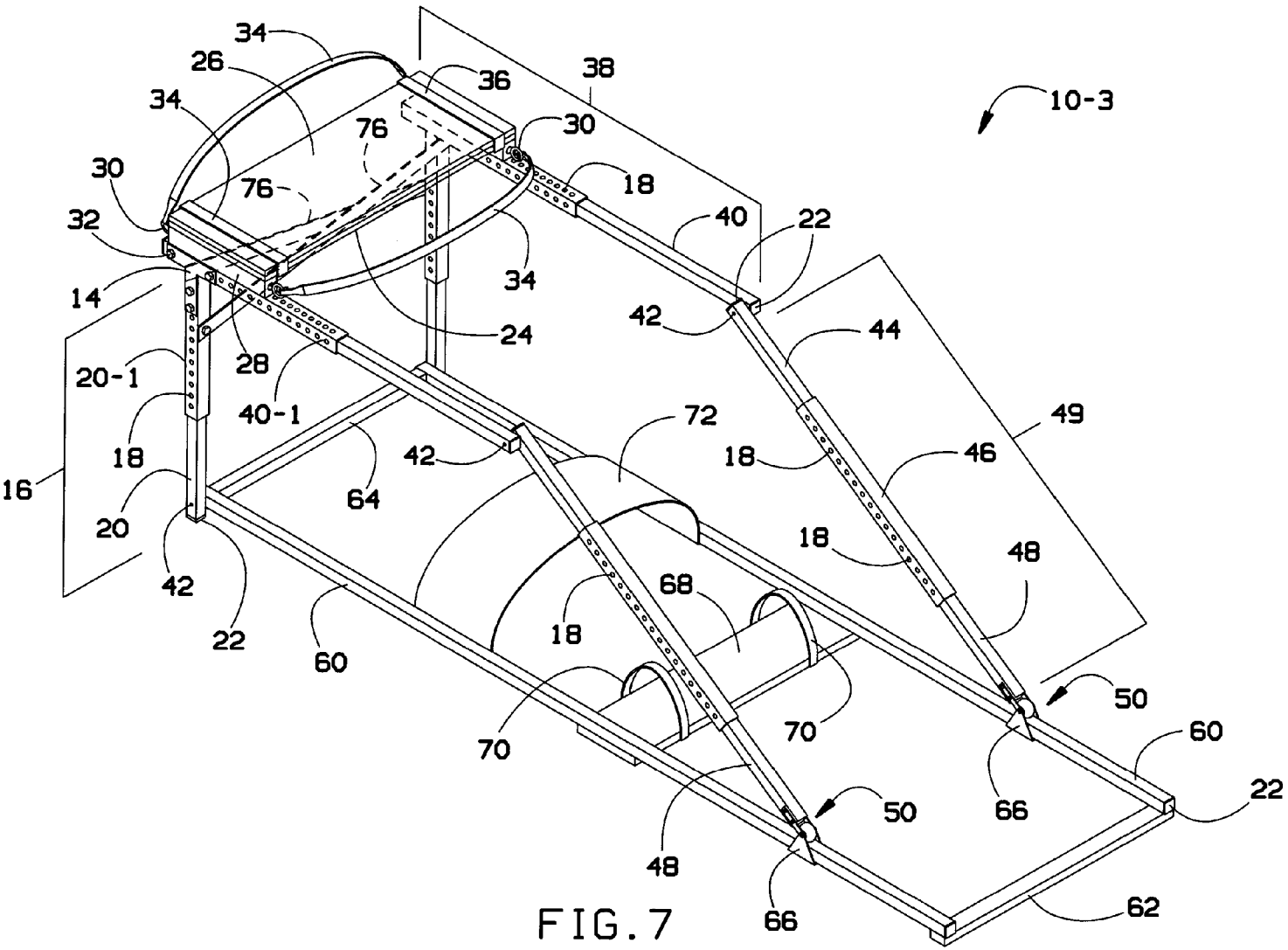
FIG. 7 is a perspective view of a stretching device according to a further alternate embodiment of the present invention.
Figure 8:
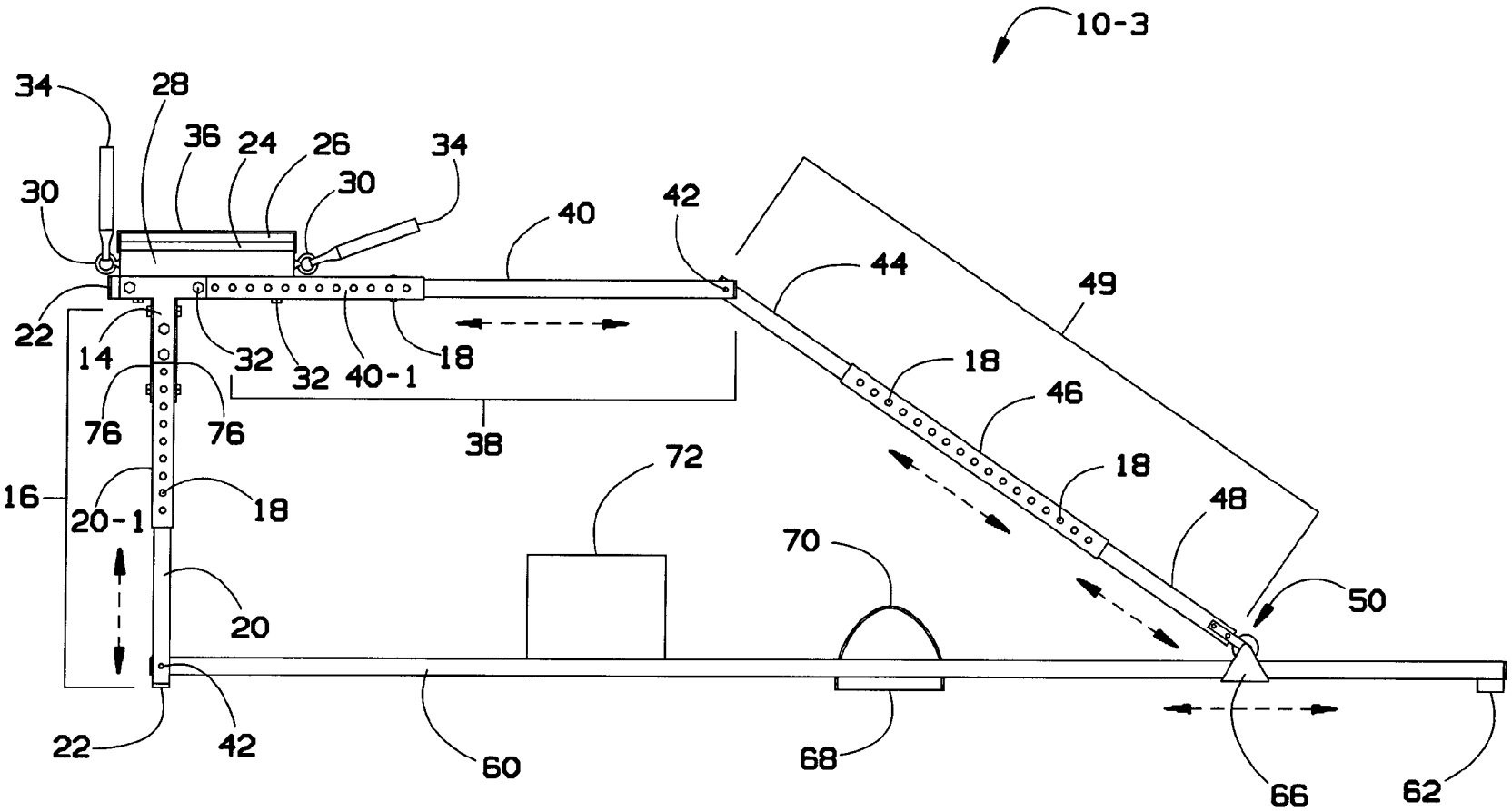
FIG. 8 is a side view of the stretching device of FIG. 7.

Referring to FIGS. 7 and 8, in a further embodiment of a stretching device 10-3, the embodiments described above may be secured to a base frame 60. The base frame 60 may include a rearward cross piece 64, connecting the first and second fulcrum legs 16, and a forward cross piece 62, connecting the base frame 60 near the first and second adjustable legs 49. Wheel rails 66 may ride the base frame 60 between the rearward and forward cross pieces 64, 62. The wheel rails 66 may be adapted to allow the wheels 50 to ride on the base frame 60 without losing contact therewith. The base frame 60 may further include a shoulder mount 68, having shoulder straps 70, spanning the base frame 60. A waistband 72 may also span the base frame 60.

Figure 9:
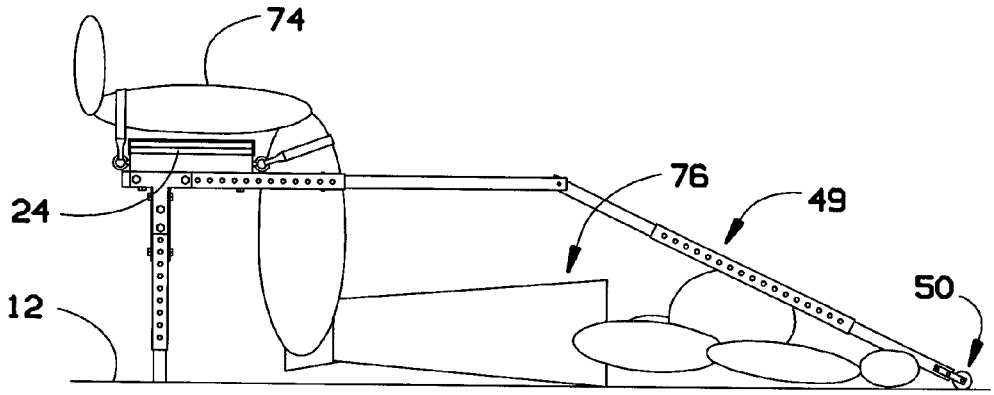
FIGS. 9 through 11 show a pictorial flow chart describing the use of the stretching device of FIG. 1.
Figure 10:
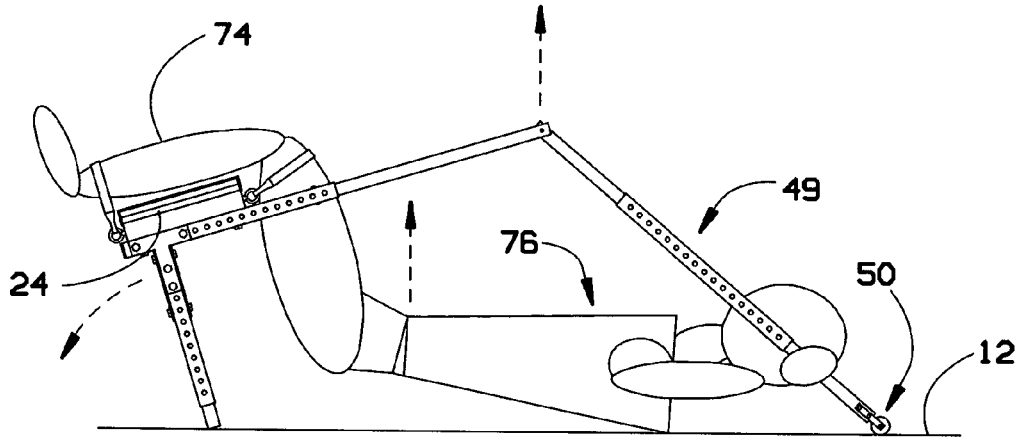
Figure 11:
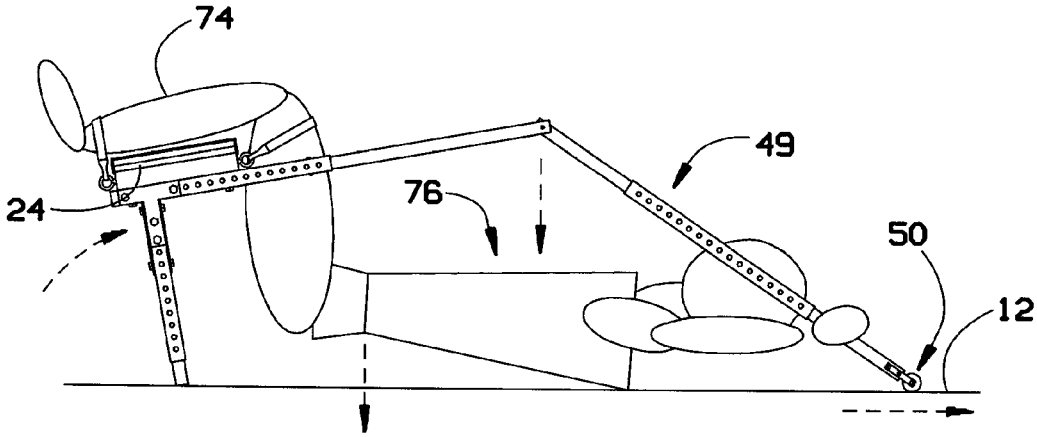

As shown in FIGS. 9 through 11, a user 76 may lie on a surface 12 and position their legs 74 on top of the platform 24. The adjustable legs 49 may be extended over the user's head. The user may grasp the adjustable legs 49 (at optional handles formed therein (not shown)) and pull the adjustable legs toward the user's torso, rotating the wheels 50 against the surface 12, causing the forward edge of the platform 24 to rise and rotate. The user 76 may then move the adjustable legs 49 back a small distance away or to the original position and repeat the process.

As discussed above, various components of the device may be adjustable by conventional means. For example, the user may adjust the height of the platform 24 to be about one-third of the user's height. The user may also adjust the position of the platform 24 relative to the fulcrum legs 16. For example, the fulcrum legs 16 may be positioned at a particular distance from the forward edge of the platform 12.

The device may be made from conventional materials and methods. For example, the frame members (fulcrum legs 16, adjustable legs 49, extension arms 38 and the like) may be made of tubular metal, while the platform 24 may be made from metal, wood, plastic or the like. Other materials may be contemplated within the scope of the present invention.

It should be understood, of course, that the foregoing relates to exemplary embodiments of the invention and that modifications may be made without departing from the spirit and scope of the invention as set forth in the following claims.

We claim:

1. A device comprising:

a platform attached to a first end of first and second extension arms;

first and second fulcrum legs extending from the first end of the first and second extension arms, respectively;

a first end of first and second adjustable legs pivotably attached to a second end of the first and second extension arms; wheels are attached to a second end of the first and second adjustable legs; a rearward cross piece connecting the first and second fulcrum legs; first and second wheel rails extending from the first and second fulcrum legs; a forward cross piece connecting the first and second wheel rails, wherein the wheel rails are adapted to provide a track for the wheels during operation of the device; a shoulder mount spanning between the first and second wheel rails; first and second shoulder straps attached to the shoulder mount; and a waist band spanning between the first and second wheel rails.

2. The device of claim 1, further comprising at least one strap adapted to hold a user's legs against the platform.

3. The device of claim 1, further comprising:

first and second riser tubes attached to first and second extension tubes, the first and second extension tubes being attached to the first and second extension arms; and an ankle strap spanning the first and second riser tubes, the ankle strap adapted to hold a user's legs against the platform.

4. The device of claim 1, wherein a length of the first and second fulcrum legs is adjustable.

5. The device of claim 1, wherein a length of the first and second extension arms is adjustable.

6. The device of claim 1, further comprising first and second elevating blocks positioned between the first and second extension arms, the first and second elevating blocks adapted to raise the platform away from the first and second extension arms.

7. The device of claim 1, wherein the first end of first and second adjustable legs pivotably attach to the second end of the first and second extension arms a distance away from the second end of the first and second extension arms.

* * * * *